United States Patent [19]

Morin

[11] 4,046,294

[45] Sept. 6, 1977

[54] ELECTRICAL INSTRUMENT HOLDER

[76] Inventor: Raymond O. Morin, 20 Eddy St., North Providence, R.I. 02911

[21] Appl. No.: 626,483

[22] Filed: Oct. 28, 1975

[51] Int. Cl.[2] ..... A45F 5/00

[52] U.S. Cl. ..... 224/5 H; 108/43; 224/25 R; 248/240

[58] Field of Search ..... 224/5 R, 5 A, 5 B, 5 E, 224/5 F, 5 G, 5 H, 5 V, 26 R, 26 B, 26 J, 25 R, 29 R, 29 E, 29 G, 46 R, 55, 54, 7 R; 108/43; 248/205 R, 216.1, 216.4, 217.1, 217.3, 240, 240.1

[56] References Cited

U.S. PATENT DOCUMENTS

| | | | |
|---|---|---|---|
| 1,144,087 | 6/1915 | Adler | 224/5 H X |
| 2,571,514 | 10/1951 | Andrews | 224/5 H X |
| 2,999,621 | 9/1961 | Kiser | 224/5 G |
| 3,200,536 | 8/1965 | Petitto, Sr. | 224/25 R X |
| 3,273,484 | 9/1966 | Lapsley | 224/5 V |
| 3,277,599 | 11/1966 | Griffeth | 224/5 G X |
| 3,282,482 | 11/1966 | Scharsu | 224/25 R X |
| 3,658,219 | 4/1972 | Van Ordt | 224/29 R X |
| 3,878,964 | 4/1975 | Fogle | 224/46 R X |

FOREIGN PATENT DOCUMENTS

| | | | |
|---|---|---|---|
| 507,820 | 1/1955 | Italy | 248/217.3 |

*Primary Examiner*—Robert J. Spar
*Assistant Examiner*—Winston H. Douglas
*Attorney, Agent, or Firm*—Barlow & Barlow

[57] ABSTRACT

An electrical instrument holder is provided with a support plate that is adapted to fasten to the body of a person and which has an arm means extending therefrom that is suitably supported substantially normal to the support plate which arm has affixed thereto an electrical meter clamping means. This device permits an electrical meter to be supported away from the body of a person in a position whereby the face thereof will be visible to the user.

3 Claims, 5 Drawing Figures

ELECTRICAL INSTRUMENT HOLDER

BACKGROUND OF THE INVENTION

The present invention relates to an electrical meter support. In the prior art there has not been available a device which would support an electrical meter from the user's body. Many devices have been provided which will support electrical meters at angles to surfaces on which they may rest and hanging devices have been provided from electrical meters to hang the same.

SUMMARY OF THE INVENTION

In the repair of electrical devices there is almost universally utilized electrical meters. The electrically meters are provided with test leads which extend therefrom to make electrical contact with the device being investigated. It frequently happens that one utilizes an electrical meter in a very awkward situation where there is no place to hang, support or place the meter in a position where it can be viewed while the user's hands are engaging the test leads on the device being investigated. The instant invention therefore provides a support device which may fasten to one's body and which has an arm extending therefrom at a position where the meter may be held at an attitude where the user can view it with great facility. To this end, the device in its preferred form comprises a clip which can attach to the user's belt or waistband or other part of one's clothing and from the clip in its supporting plate means there extends an arm and to the arm the electrical meter is clamped.

DESCRIPTION OF THE PREFERRED EMBODIMENT

Figure 1:
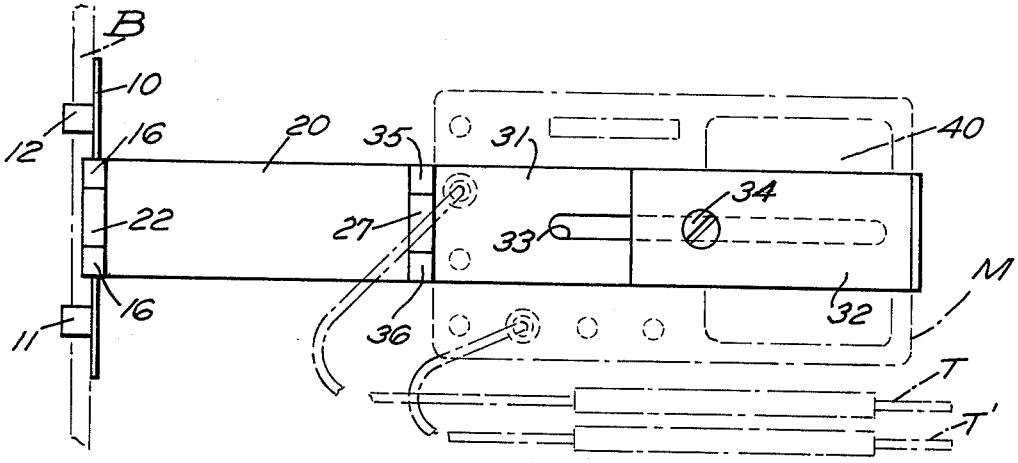
FIG. 1 is a top plan view of the instant invention.

Referring now to the drawings the instrument holder comprises a support plate 10 which is provided with a pair of spring clips 11 and 12 that extend rearward of the plate so as to engage a belt or another portion of the clothing of the user which is generally designated by the letter B. The support plate also is provided with a pair of apertures adjacent the clips 11 and 12 which apertures are designated 13 and 14, the purpose of which will presently become obvious.

An arm 20 extends from the support plate and in the preferred form of the invention is pivotally related to the support plate by a hinge pin 21 and a hinge barrel 22 which cooperates with the hinge barrels 16 and 17 that extend from the support plate 10 at the upper edge thereof. The arm 20 should lie substantially perpendicular to the face of the support plate and to achieve this, the arm 20 is bent to provide a leg portion 24 which is adapted to rest against the face surface of the support plate 10.

Means are provided in the form of an electrical meter clamp that are attached to the arm 20. This means generally designated as a body part 30 is shown as a two-part device consisting of two L-shaped portions 31 and 32 defining legs at right angles to the body. The portion

31 has a slot 33 therein, while the portion 32 carries a clamp screw 34 with a clamp nut 37. The screw 34 rides in the slot 33 and logitudinally adjusts the parts 31 and 32 relative to each other. For ease of assembly the part 31 carries a pair of hinge barrels 35 and 36 which relate through a hinge pin 26 to a hinge barrel 27 of the arm 20.

Figure 3:
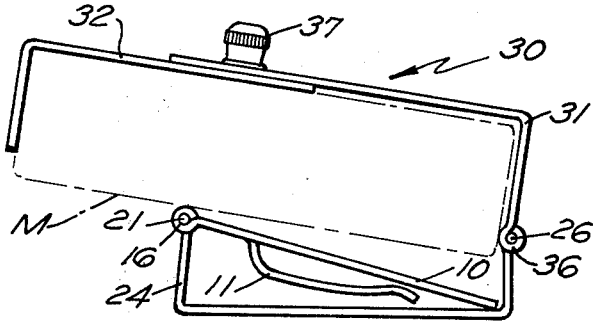
FIG. 3 is a side elevational view in folded position.
Figure 4:
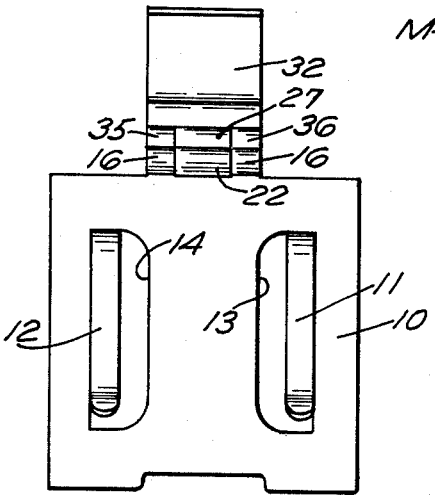
FIG. 4 is an end elevational view looking from the lefthand side of FIGS. 1 and 2.

As will be seen in FIG. 3 of the drawings, the hinging arrangement between the support plate and the arm and the meter clamp enables the support plate to be swung in an arc of approximately 270° to provide for ease in folding the instrument holder into a compact package that may be readily inserted in one's pocket. The meter M which is shown in broken line in the drawings may rest within its holder while the arm 20 and the support plate 10 will effectively fold into a position in and along one face of the meter.

Figure 2:
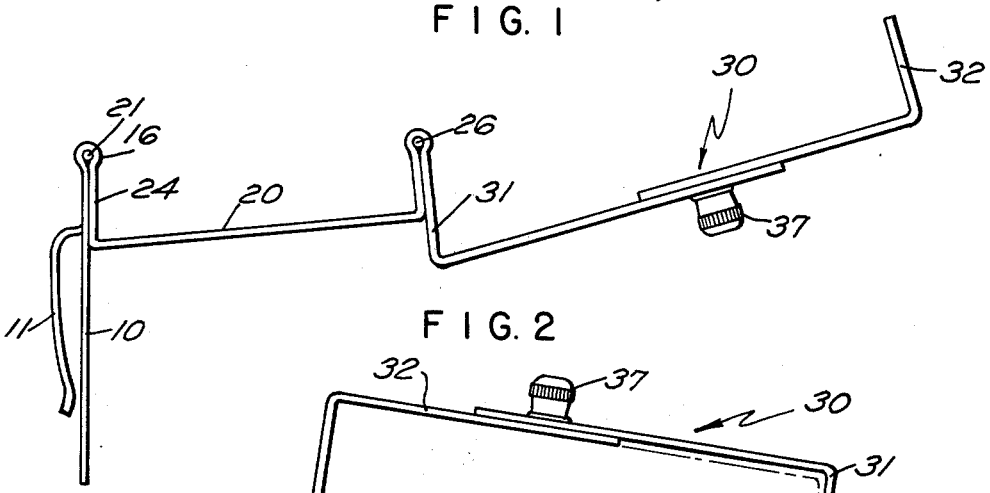
FIG. 2 is a side elevation thereof in open position.

In use as seen in FIG. 1 of the drawings the electrical meter M will be suspended substantially perpendicular to one's body inasmuch as the support plate will be fastened to a belt or the like and due to the natural tendency for the belt to twist, the meter itself will lie at an angle down from that illustrated, for example, in FIG. 2 since the entire assembly will be effectively twisted clockwise as viewed in FIG. 2. The meter, however, is completely held in position by the clamping means and accordingly leaves the test probes indicated by the letters T and T′ free to be manipulated by one's hands. At the same time the viewing window which may be located as, for example, at the position indicated by the reference numeral 40 will be in a position to be readily seen by the user.

Figure 5:
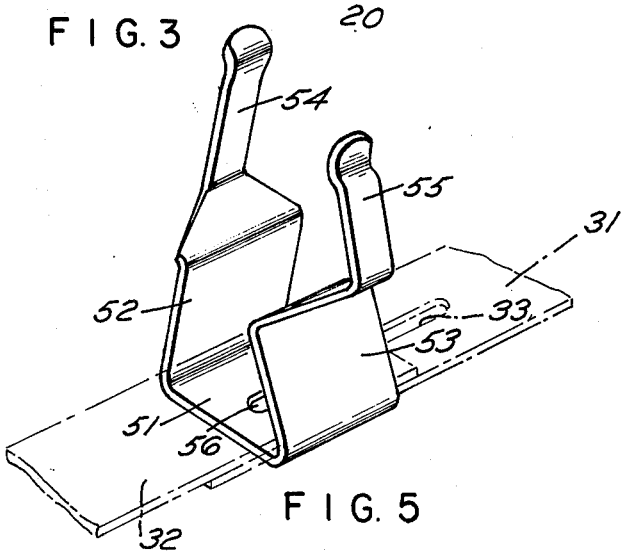
FIG. 5 is a perspective view of an auxiliary clip for use with a different type of meter.

In some cases electrical meters may not be of rectangular form as illustrated in FIGS. 1 and 3 of the drawings, and to this end, a universal clip device as indicated in FIG. 5 may be used. This clip device has a base portion 51 with a pair of upstanding arms 52 and 53 which terminate in smaller cross sectional spring arm portions 54 and 55 respectively. The base portion 51 is provided with an aperture 56 and is of a width to embrace the clamping means 30 with the fastening screw 34 passing through the aperture 56 and being secured by the nut 37. This particular device lends itself to being used with combination AC ammeters and volt, ohm and milli ammeters that take a form with a narrow neck portion between the indicating meter and the portion that clamps around a wire in the form of a pair of expanding C-shaped fingers.

It will therefore be seen that there is provided by the instant invention a device which provides utility for holding an electrical meter in a usable position to free one's hands and to make it visible to the user thereof. Additionally the device may be readily folded up either with the meter installed or without the meter installed and assuming, for example, that the device of FIG. 5 is installed on the unit, the apertures 13 and 14 provide a passage for the fingers 54, 55 so that the entire device may be folded up even further than that as illustrated in FIG. 3.

I claim:

1. A body mounted electrical instrument holder comprising a support plate having a flat surface with edges, means for supporting said plate from a person's body so that one edge defines an upper edge, an arm having legs at its ends extending at generally right angles thereto, one of the legs hinged at its free end to the upper edge of said support plate to rest against said support plate when the arm and legs are relatively swung in an arc of approximately 270° about the support plate, an electrical meter clamp having a generally flat inner body portion to receive a meter, said body portion having a leg at one end thereof extending at generally right angles to the flat body portion and hinged at its free end to the free end of the other of the legs of said arm to rest against said other leg and support the meter clamp in generally horizontal extension of said arm, said support plate after removal from the supporting position on the body portion swinging in an arc of approximately 270° to collapse the holder whereby the support plate may be swung over the arm and the meter clamp swung over the plate and arm from the other end of the arm into folded position.

2. A body mounted electrical instrument holder as in claim 1 wherein said meter clamp comprises an adjustable L-shaped plate that faces said leg of the body portion whereby opposite end walls of an electrical meter may be gripped.

3. A body mounted electrical instrument holder as in claim 1 wherein said meter clamp comprises a pair of spring fingers rising from the body position that engage opposite wall sections of an electrical meter.

* * * * *